US005361915A

United States Patent [19]

Cohen et al.

[11] Patent Number: 5,361,915

[45] Date of Patent: Nov. 8, 1994

[54] ROTATABLE STORAGE RECEPTACLE FOR KNIVES AND KITCHEN TOOLS, UTENSILS AND GADGETS

[75] Inventors: Milton L. Cohen, Hewlett Bay Park; Jeff Siegel, Great Neck, both of N.Y.

[73] Assignee: Lifetime Hoan Corporation, Brooklyn, N.Y.

[21] Appl. No.: 91,241

[22] Filed: Jul. 12, 1993

[51] Int. Cl.[5] ..... A47F 7/00

[52] U.S. Cl. ..... 211/70.7; D7/637; 211/70; 211/163; 248/37.3

[58] Field of Search ..... 211/70, 70.6, 70.7, 211/60.1, 163; 248/37.3; D7/637

[56] References Cited

U.S. PATENT DOCUMENTS

| | | | |
|---|---|---|---|
| D. 271,171 | 11/1983 | Kinkade | D7/637 |
| D. 329,766 | 9/1992 | Ancona et al. | 211/70 X |
| D.334,265 | 3/1993 | Giugiaro | D7/637 X |
| 3,848,943 | 11/1974 | Geesaman et al. | 211/70.7 X |
| 4,412,618 | 11/1983 | La Conte | 211/70.6 X |
| 4,423,552 | 1/1984 | Bourgein et al. | 248/37.3 X |
| 4,534,474 | 8/1985 | Na | 211/70.7 X |
| 4,936,470 | 6/1990 | Prindle | 211/70.7 |

FOREIGN PATENT DOCUMENTS 2058548 4/1981 United Kingdom ..... 211/70

OTHER PUBLICATIONS

Hong Kong Enterprise, Aug. 1983, p. 154.

*Primary Examiner*—Robert W. Gibson, Jr.
*Attorney, Agent, or Firm*—Goodman & Teitelbaum

[57] ABSTRACT

A storage receptacle including a receptacle portion rotatably mounted on a base portion, the receptacle portion including two sections for receiving knives and kitchen tools, utensils and gadgets therein, the two sections being fixedly secured together. One section includes a front portion having a downwardly inclined top wall with slots therein to receive knives with long blades having different lengths and widths, and a rectangular cut-out to receive kitchen shears therein. The other section includes a central portion to receive kitchen tools, utensils and gadgets having variable lengths, a rear partitioned portion to receive kitchen tools and utensils therein, and opposing side portions having top walls with slots therein to receive knives with short blades of the same length and width. Preferably, the receptacle portion is hollow and fabricated from a plastic material.

20 Claims, 4 Drawing Sheets

ROTATABLE STORAGE RECEPTACLE FOR KNIVES AND KITCHEN TOOLS, UTENSILS AND GADGETS

BACKGROUND OF THE INVENTION

The invention relates to a storage receptacle, and more particularly to a storage receptacle which includes an upper receptacle portion which is rotatably mounted on a lower base portion, the receptacle portion including sections for receiving knives and kitchen tools, utensils and gadgets in a predetermined arrangement.

Storage receptacles for knives and kitchen tools, utensils and gadgets are well known in the art, where these prior art storage receptacles have been made in many different constructions to provide different designs thereof. U.S. Pat. No. 4,305,511 discloses a utensil storage device for knives, kitchen utensils and tools including annular tiers of storage pockets surrounding a central hollow cylinder whose top is slotted to support bladed knives and utensils, the storage device being a unitary molded plastic structure. U.S. Pat. Des. No. 271,171 discloses a knife holder including an inclined body having a slotted inclined front face for receiving the knife blades therein.

Other types and designs of storage receptacles are disclosed in U.S. Pat. Nos. 3,796,454 and 4,509,651, as well as in U.S. Pat. Des. Nos. 280,587, 292,359, 300,497, 308,619, 317,699 and 329,359. Obviously, there are many more patents disclosing storage receptacles, which are too numerous to list herein.

Many of the prior art storage receptacles are constructed to receive only knives having blades of the same length, only knives having both long and short blades, only tools, utensils and gadgets having the same length, or as disclosed in the above-mentioned U.S. Pat. No. 4,305,511 only blades having the same width in addition to tools or utensils having different lengths.

Accordingly, there is presently a need for a storage receptacle which can be rotated for easy use thereof, which indludes sections to receive knives having the same blade length, another section for receiving knives having different blade lengths and different widths, and further sections for receiving tools, utensils and gadgets having different lengths, and which is inexpensive to manufacture and therefore can be sold at a reasonable price.

SUMMARY OF THE INVENTION

It is accordingly an object of the present invention to provide a storage receptacle for knives and kitchen tools, utensils and gadgets which avoids the disadvantages of the prior art storage receptacles.

Another object of the present invention is to provide a storage receptacle, which includes a receptacle portion rotatably mounted on a base portion.

A further object of the present invention is to provide a storage receptacle, where the receptacle portion includes a front portion having a downwardly inclined top wall with slots of varying size therein to receive knives with long blades having different lengths and widths, and a rectangular cut-out to receive kitchen shears therein.

Still another object of the present invention is to provide a storage receptacle, where the receptacle portion includes opposing side portions having upper walls with slots therein to receive knives with short blades of the same length and width.

Yet another object of the present invention is to provide a storage receptacle, where the receptacle portion includes a rear partitioned portion to receive kitchen tools and utensils therein.

Still another object of the present invention is to provide a storage receptacle, where the receptacle portion includes a central portion to receive kitchen tools, utensils and gadgets having varying lengths.

Another object of the present invention is to provide a storage receptacle which is hollow and fabricated from a plastic material, is inexpensive to manufacture, and can be sold at a reasonable price.

Briefly, in accordance with the present invention, there is provided a storage receptacle including a receptacle portion rotatably mounted on a base portion, the receptacle portion including two sections for receiving knives and kitchen tools, utensils and gadgets therein, and means for fixedly securing the two sections together. One section includes a front portion having a downwardly inclined top wall with means therein to receive knives with long blades having different lengths and widths, and also to receive kitchen shears therein. The other section includes a central portion to receive kitchen tools, utensils and gadgets having variable lengths, a rear partitioned portion to receive kitchen tools and utensils therein, and opposing side portions having top walls with means therein to receive knives with short blades of the same length and width. Preferably, the receptacle portion is hollow and fabricated from a plastic material.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
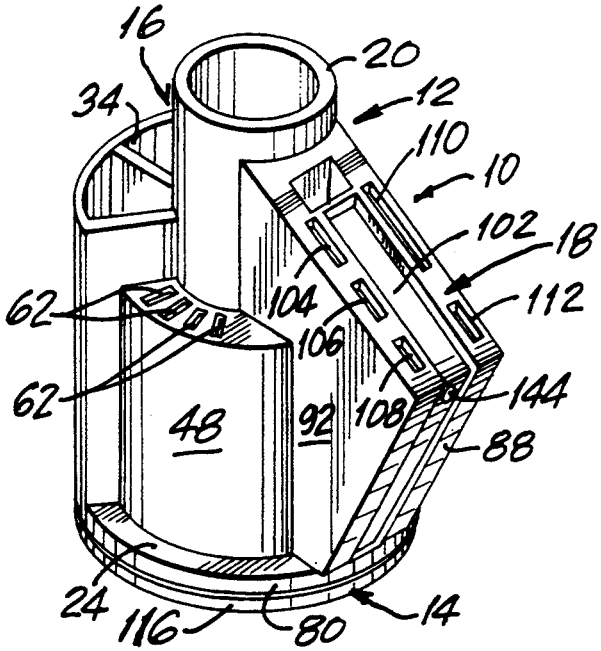
FIG. 1 is a perspective view of a rotatable storage receptacle for knives and kitchen tools, utensils and gadgets in accordance with the present invention.

Referring now to the drawings, FIGS. 1-6 show various views of the rotatable storage receptacle 10 for knives and kitchen tools, utensils and gadgets in accordance with the present invention. The storage receptacle 10 includes an upper hollow receptacle portion 12 which is rotatably mounted on a lower base portion 14, as will be set forth below. The receptacle portion 12 includes a body section 16 to which is connected a front section 18 in a manner set forth below. The front section 18 extends outwardly from the body section 16 beyond the base portion 14, as best shown in FIGS. 1, 3, 5 and 6, for easy access thereto as set forth below.

Figure 7:
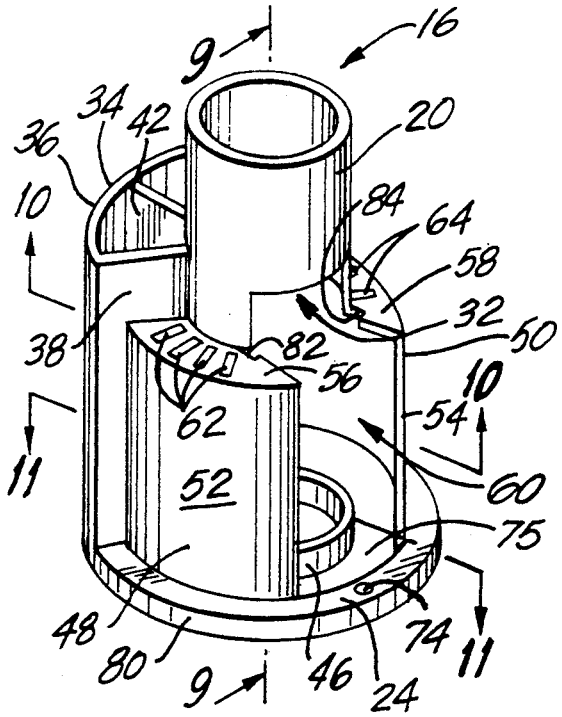
FIG. 7 is a perspective view of a body section of the storage receptacle.
Figure 8:
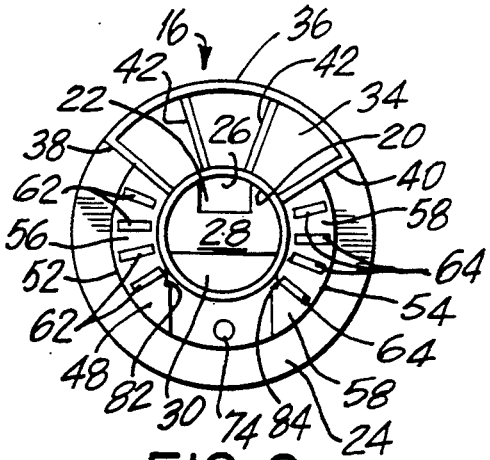
FIG. 8 is a top plan view of the body section.
Figure 9:
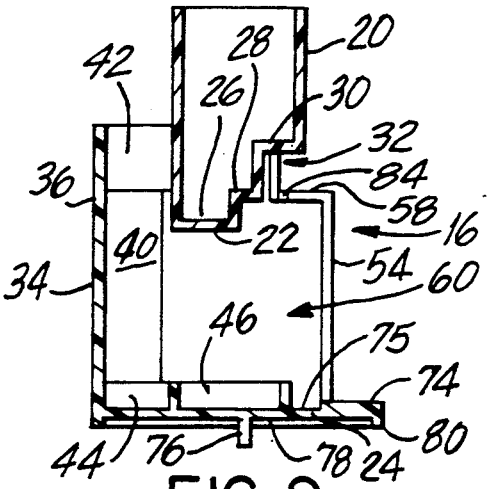
FIG. 9 is a sectional view taken along line 9—9 of FIG. 7.

The body section 16, as shown more particularly in FIGS. 7-12, includes a centrally located, hollow, circular central storage portion 20 open at the top thereof to receive different types of kitchen tools, utensils and gadgets therein such as peelers, strainers, paring knives, mashers and the like. As best shown in FIG. 9, the central storage portion 20 has a closed bottom end formed by a step-like bottom wall 22 which is disposed approximately midway between the top of the central portion 20 and a bottom plate 24 of the body section 16. The step-like bottom wall 22 forms a substantially rectangular shaped receptacle 26 for longer items. A platform 28 is provided around the receptacle 26 for intermediate length items. A raised shelf 30 is disposed opposite the receptacle 26 for short items. It is noted, that the raised shelf 30 forms an opening 32 in the front wall of the circular portion 20, which will be discussed below.

Figure 11:
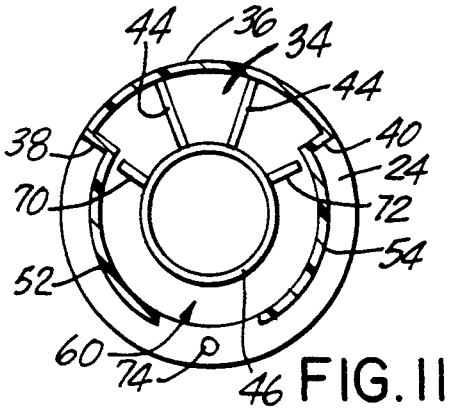
FIG. 11 is a sectional view taken along line 11—11 of FIG. 7.

The rear storage portion 34 is secured to the rear wall of the central portion 20 below the opened top of the central portion 20, and extends downwardly to the bottom plate 24 so that the rear portion 34 suspends the central portion 20 in a fixed position above the bottom plate 24. The rear portion 34 is opened at the top thereof and includes a rear wall 36 which is curved to conform to the curvature of the circular bottom plate 24, as best shown in FIGS. 8 and 11, the rear wall 36 having an arc greater than 90 degrees. The side walls 38, 40 extend radially inwardly and are connected to the central portion 20 as well as being connected to the bottom plate 24.

A pair of partition walls 42 extend radially between the rear wall 36 of the rear portion 34 and the rear wall of the central portion 20 to both section off the rear portion 34 and to provide added support for the central portion 20. The partitions 42 extend downwardly in the rear portion 34 only part of the way, and end above the receptacle 26 at about the same level as the platform 28.

Accordingly, two lower partition members 44 are provided on the bottom plate 24 in alignment with the partition members 42. The partition members 44 are also connected to the rear wall 36, and extend radially inwardly to a circular abutment member 46 also provided on the bottom plate 24 in alignment with the circular walls of the central portion 20 disposed above. Thus, the rear storage portion 34 receives longer items therein, such as long spoons, long turners, carving and serving forks and the like, where the partition members 42 and 44 maintain these long kitchen items in an upright position.

A pair of side storage portions 48 and 50, disposed on opposite sides of the central storage portion 20, extend inwardly and forwardly from the rear storage portion 34, and extend upwardly from the bottom plate 24, as shown in FIGS. 7 and 8. Each of the side storage portions 48, 50 includes a curved outer side wall 52, 54 having the rear portion thereof integrally joined to the side walls 38, 40, respectively, of the rear storage portion 34, and the bottom portion thereof being integrally joined to the upper surface of the bottom plate 24. The side walls 52, 54 are inwardly spaced from the outer edge of the bottom plate 24 and have the same curvature thereof, as best shown in FIGS. 7, 8 and 11, where the side walls 52, 54 each have an arc of approximately 90 degrees.

The top walls 54, 56 of the side storage portions 48, 50, respectively, are disposed parallel to the bottom plate 24, being integrally joined to the side walls 52, 54, the side walls 38, 40 of the rear storage portion 34 and the opposing side walls of the central portion 20, respectively. Accordingly, the front edges of the side walls 52, 54 and the top walls 56, 58 of the side storage portions 48, 50 are spaced apart to provide a front opening 60 therebetween in communication with the opening 32 in the front wall of the central portion 20, which will be discussed below.

Figure 10:
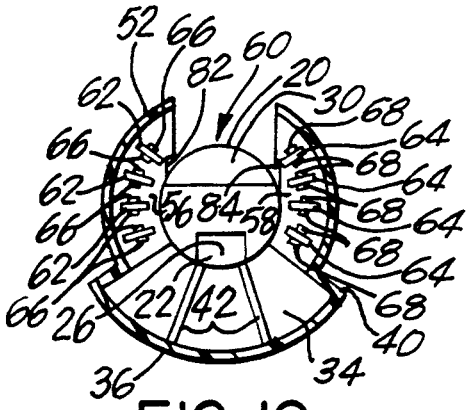
FIG. 10 a sectional view taken along line 10—10 of FIG. 7.

Each of the top walls 56, 58 are provided with numerous radially extending slots 62, 64, respectively, namely four slots for each, for receiving the blades of knives therein, particularly steak knives having the same width and length. As best shown in FIG. 10, downwardly extending tabs 66, 68 are formed integrally on the inner surface of the top walls 56, 58, respectively, so that a pair of tabs 66, 68 is disposed on opposite sides of each of the slots 62, 64 to guide the knife blades therethrough and to maintain the knives in an upright position. It is noted, that the circular abutment member 46, best shown in FIG. 11, also functions to maintain the knives in the upright position. Additional partition members 70, 72, shown in FIG. 11, extend radially outwardly from the circular abutment member 46, having the same height as the abutment member 46 and being disposed adjacent to the bottom portions of the side walls 38, 40, respectively, of the rear storage portion 34 in order to to separate the bottom portions of the side storage portions 48, 50 from the bottom portions of the rear storage portion 34.

Additionally, a hole 74 is provided through the front portion of the bottom plate 24 in front of the front opening 60 in between the side storage portions 48, 50, the function of which will be explained below.

Within the hollow interior of the body section 16, a recess 75 is provided in the upper surface of the bottom plate 24, being bound by the rear wall 36, the side walls 38, 40 and the side walls 52, 54, with the front wall of the recess 75 being at the front opening 60, the function thereof being set forth below.

Figure 12:
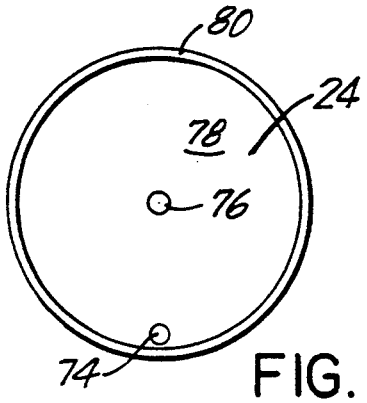
FIG. 12 is a bottom plan view of the body section.

An integral circular pin or rod 76, shown in FIGS. 9 and 12, extends outwardly and downwardly from the center of the bottom surface 78 of the bottom plate 24, the function of which also will be explained below. It is noted, that the bottom surface 78 of the bottom plate 24 is recessed to form a downwardly extending rim 80 around the outer perimeter of the bottom plate 24, as best shown in FIGS. 9 and 12. Furthermore, cut-outs 82, 84 are provided in the front edges of the top walls 56, 58 of the side storage portions 48, 50, respectively, adjacent to the front wall of the central portion 20 in communication with the junction of the front openings 32 and 60, the function of which will be discussed below.

Figure 13:
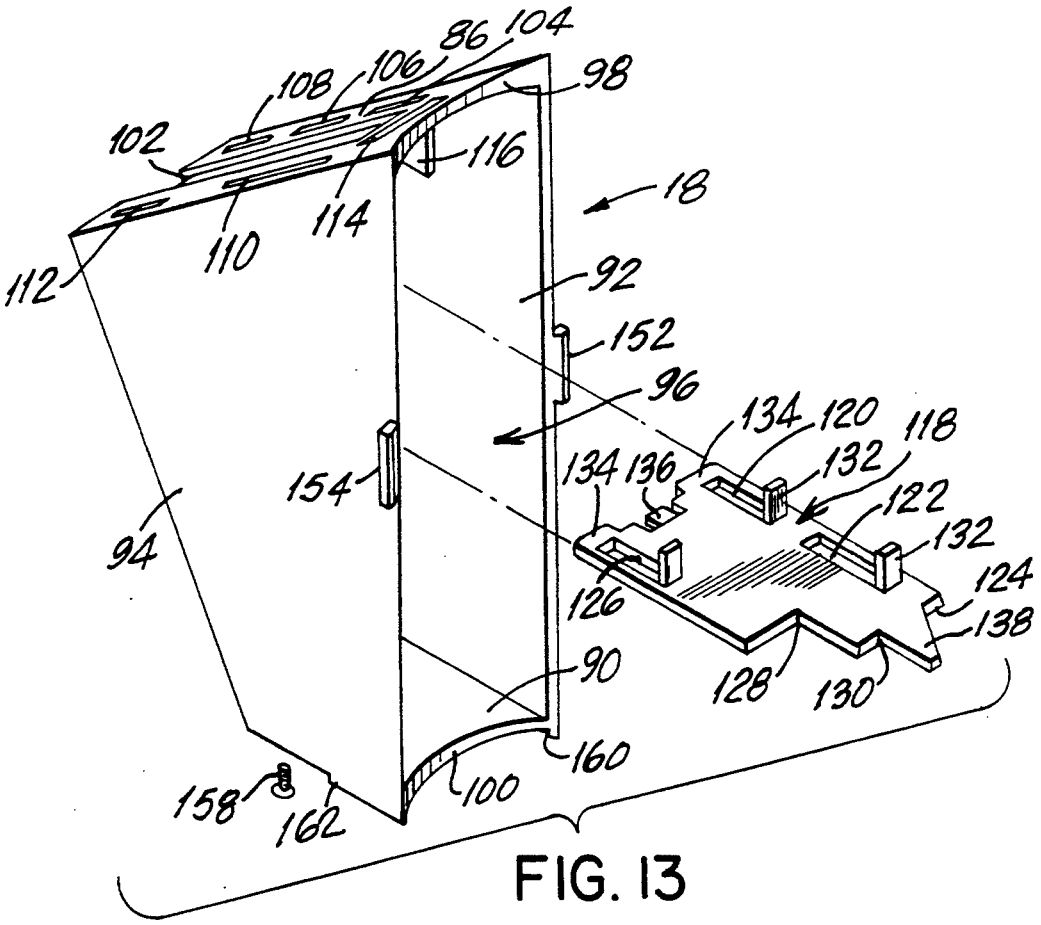
FIG. 13 is an exploded perspective view of a front section of the storage receptacle.
Figure 14:
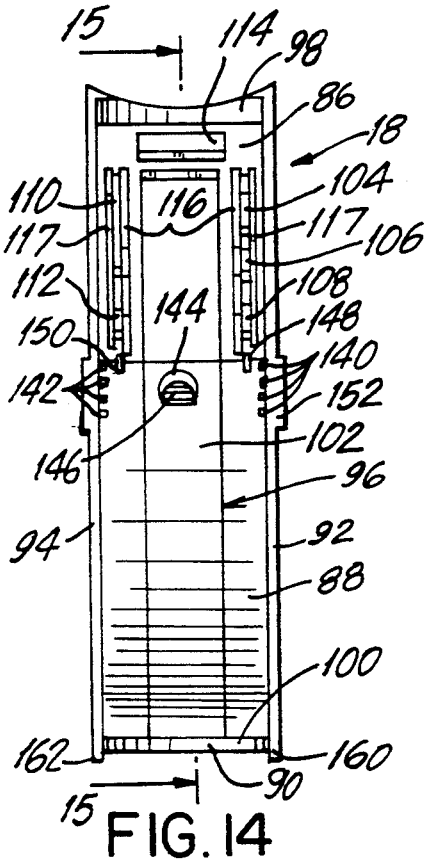
FIG. 14 is a rear elevational view of the front section.
Figure 15:
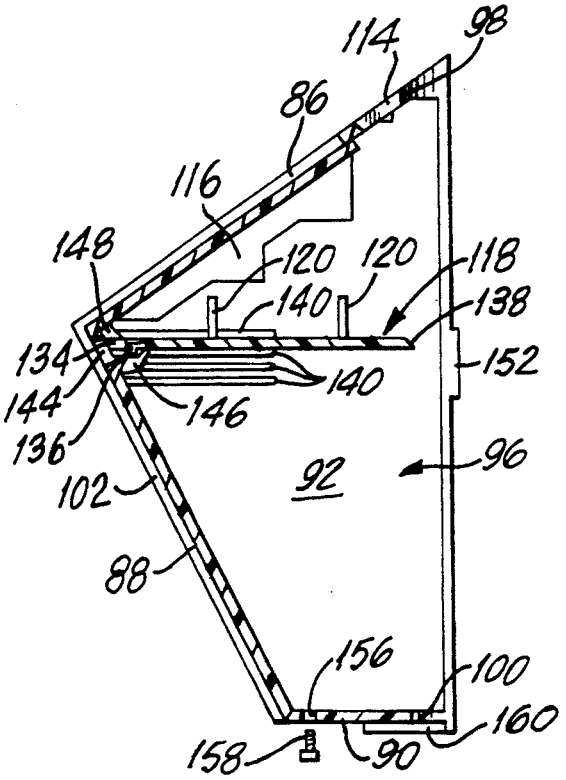
FIG. 15 is a sectional view taken along line 15—15 of FIG. 14.

FIGS. 13, 14 and 15 show the front section 18 which includes an outwardly downwardly inclined top wall 86, a front wall 88 inclining inwardly in a downward direction from the top wall 86 to a horizontal bottom wall 90, and side walls 92 and 94 to provide a rear opening 96. The rear edge 98 of the top wall 86 is curved inwardly to match the circular configuration of the central portion 20, and the rear edge 100 of the bottom wall 90 is also curved inwardly to match the configuration of the abutment member 46 on the bottom plate 24. Preferably, as a matter of design, a recess 102 runs from the top wall 86 and through the front wall 88, as best shown in FIG. 1.

Figure 2:
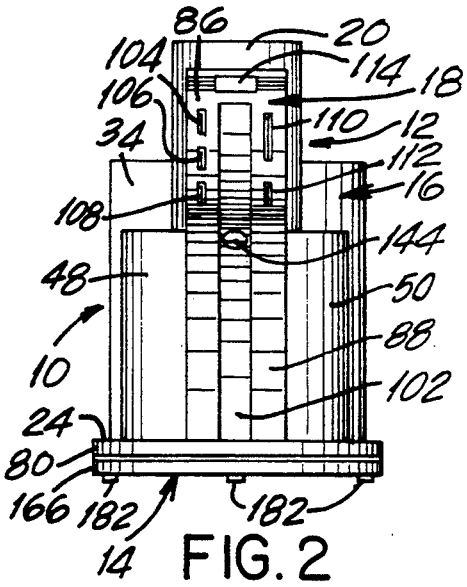
FIG. 2 is a front elevational view of the storage receptacle.

As best shown in FIGS. 1, 2 and 13, three longitudinally extending slots 104, 106 and 108 of varying predetermined lengths are provided through the top wall 86 on one side of the recess 102, and two longitudinally extending slots 110 and 112 of varying predetermined lengths are provided through the top wall 86 on the other side of the recess 102 to receive the long blades of different types of knives having different lengths and widths. For example, a bread knife would be received in slot 104, a boning knife would be received in slot 106, a utility knife would be received in slot 108, a chef knife would be received in slot 110 and a paring knife would be received in slot 112. Additionally, a rectangular cut-out or hole 114 is provided through a rear portion of the top wall 86 between the central portion 20 and the recess 102, as best shown in FIG. 1, to receive kitchen shears therein.

As shown in FIGS. 14 and 15, a pair of elongated guide members 116 integrally extend downwardly from the inner surface of the top wall 86 adjacent the slots 104, 106, 108, on one side thereof, and the slots 110, 112, on an adjacent side thereof, where the respective guide members 116 are disposed between the associated slots and the recess 102. As shown in FIG. 14, another pair of elongated guide members 117 also integrally extend downwardly from the inner surface of the top wall 86, being disposed on an opposite side of the slots 104, 106, 108 and also the slots 110, 112 for cooperating with an associated one of the guide members 116, where the respective guide members 117 are disposed between the associated slots and the associated side walls 92, 94.

It is noted, that the guide members 117 extend downwardly a shorter vertical distance than the guide members 116 because of the closeness thereof to the side walls 92, 94 which limit the transverse movement of the knife blades to the inner surfaces of the side walls 92, 94. Thus, each set of guide members 116 and 117 coact together to guide the knives into the slots in the front section 18 in a desired straight path.

In order to maintain the knives in a straight inclined position relative to the inclined top wall 86, an insert member 118 is provided, as best shown in FIGS. 13 and 15, where the insert member 118 is not shown in FIG. 14 in order to illustrate other portions of the front section 18. The insert member 118 is flat and includes on one side thereof a slot 120 therethrough for association with the top wall slot 108, a slot 122 therethrough for association with the top wall slot 106, and a cut-out portion 124 for association with the top wall slot 104. On the opposite side, the insert member includes a slot 126 therethrough for association with the top wall slot 112, a cut-out 128 for association with the top wall slot 110, and finally a further cut-out portion 130 for association with the top wall rectangular cut-out 114.

Upwardly extending tabs 132 are formed integrally on the upper surface of the insert member 118 at the rear ends of the slots 120, 122 and 126 to guide the knife blades into the slots 120, 122 and 126, respectively. A pair of outwardly extending abutment tabs 134 are provided on opposite sides of the front end of the insert member 118, the function of which will be set forth below. Additionally, a resilient hook 136 having a downwardly extending end portion is also provided on the front end of the insert member 118, being disposed between the abutment tabs 134 and being positioned rearwardly of the abutment tabs 134, the function of which will also be set forth below. A further abutment tab 138 extends outwardly from the rear end of the insert member 118, which will be discussed below.

In order to position and maintain the insert member 118 within the front section 18, a series of elongated horizontally disposed ribs 140, 142 are integrally formed on the inner surfaces of the side walls 92, 94, respectively, in a vertical spaced apart arrangement, as best shown in FIGS. 14, 15, to provide guideways therebetween for receiving the insert member 118. Accordingly, each of the ribs 140 on the side wall 92 is in horizontal alignment with an associated one of the ribs 142 on the side wall 94. Furthermore, each vertical spacing in each series between the adjacent ribs 140 and 142 is approximately equal to the thickness of the insert member 118, so that the insert member 118 can slide therebetween, as set forth below.

The front wall 88 has a hole 144 therethrough to form, on the inner surface thereof, an outwardly extending resilient hook 146 having an upwardly extending end portion. A pair of abutment members 148, 150 are also formed on the inner surface of the front wall 88 adjacent the top wall 86, as best shown in FIGS. 14 and 15. The resilient hook 146 is spaced between and below the abutment members 148, 150, where the resilient hook 146 and the abutment members 148, 150 are positioned relative to the ribs 140, 142 for association therewith, as will be explained below.

Before inserting the insert member 118, a selection is made of the associated pairs of ribs 140, 142 between which the insert member 118 will slide so that the insert member 118 coacts with the resilient hook 146 and the abutment members 148, 150. As shown in FIG. 15, the top two pairs of ribs 140, 142 on each side have been selected, and the insert member 118 has been slidingly inserted through the guideway therebetween. The insert member 118 is pushed all the way into the front section 18 so that the abutment tabs 134 are engaged under the abutment members 148, 150, and at the same time, the resilient hook 136 of the insert member 118 snaps over and locks onto the resilient hook 146 of the front section 18, thus securing the insert member 118 in the front section 18 in a fixed position.

As best shown in FIG. 13, a pair of aligned locking tabs 152, 154 are provided on the rear edges of the side walls 92, 94, respectively, of the front section 18, the function of which will be explained below. Additionally, as best shown in FIG. 15, a hole 156 is formed through the bottom wall 90 of the front section 18, the hole 156 being positioned for alignment with the hole 74 in the bottom plate 24, as will be explained below. Furthermore, a self-threading screw 158 is provided for passing through the hole 74 in the bottom plate 24 and threading itself into the hole 156 in the bottom wall 90, as also will be explained below. It is further noted, that a pair of horizontal extending flanges 160, 162 extend downwardly from the side walls 92, 94, respectively, beyond the bottom wall 90, where the ribs 160, 162 extend from the rear edge 100 of the bottom wall 90 for only approximately half way across the bottom wall 90, the function of which will be explained below.

Figure 16:
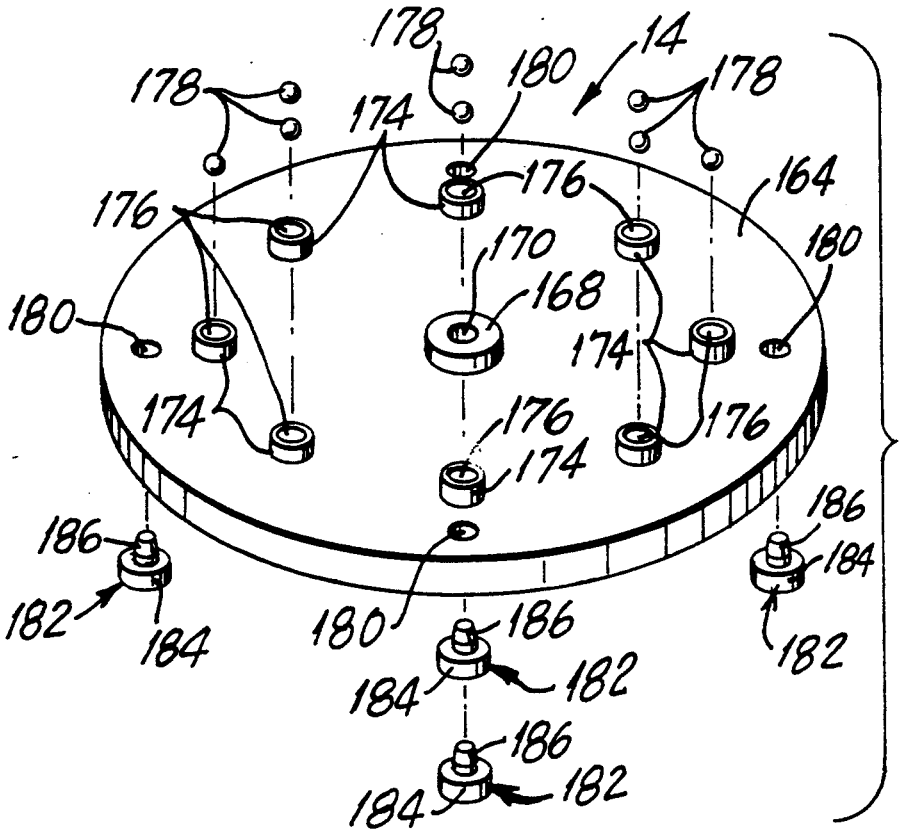
FIG. 16 is an exploded perspective view of the base portion.
Figure 17:
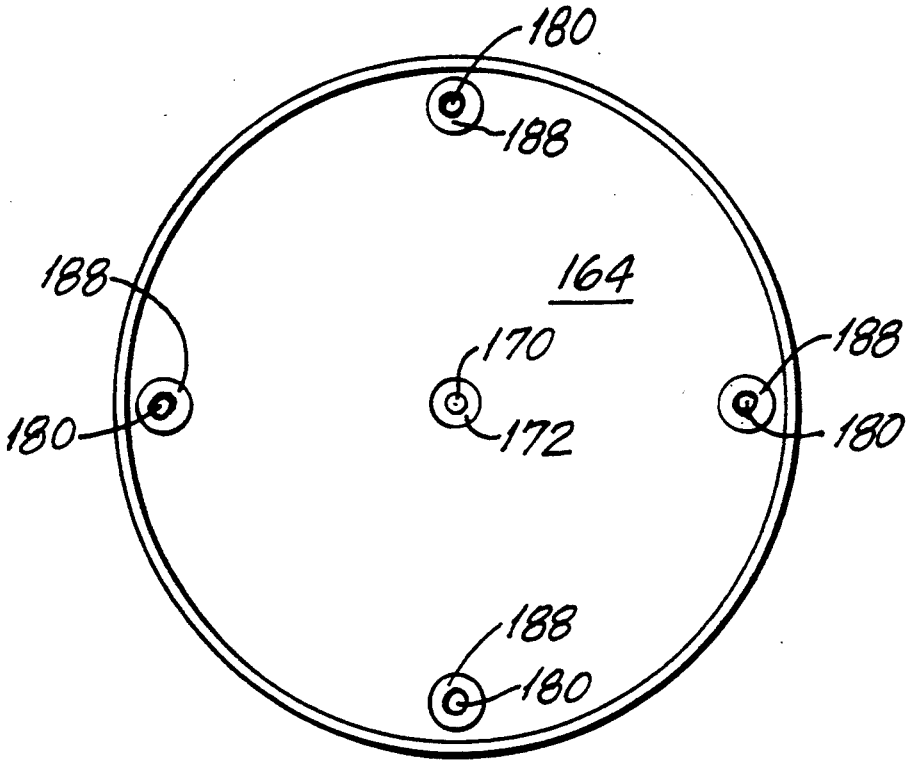
FIG. 17 is a bottom plan view of the circular flat portion of the base portion.

FIGS. 16 and 17 show the base portion 14 which includes a circular flat portion 164 having a downwardly extending circular skirt 166 around the perimeter thereof. It is noted, that the base portion 14 has the same diameter as the bottom plate 24. A circular boss 168 having a hole 170 therethrough is formed on the center portion of the top surface of the flat portion 164. On the reverse side, as shown in FIG. 17, a centrally located recess 172 is formed in the bottom surface of the flat portion 164 and extends into the boss 168, the function of which will be explained below. Equally spaced circularly around the boss 168 on the top surface of the flat portion 164 are smaller bosses 174, where preferably there are eight bosses 174. The bosses 174 have approximately the same height as the central boss 168. A blind recess 176 is formed in the top of each of the bosses 174 to receive one of the ball bearings 178 therein so that the ball bearings 178 extend outwardly from the top of the bosses 174, as will be explained below.

Figure 3:
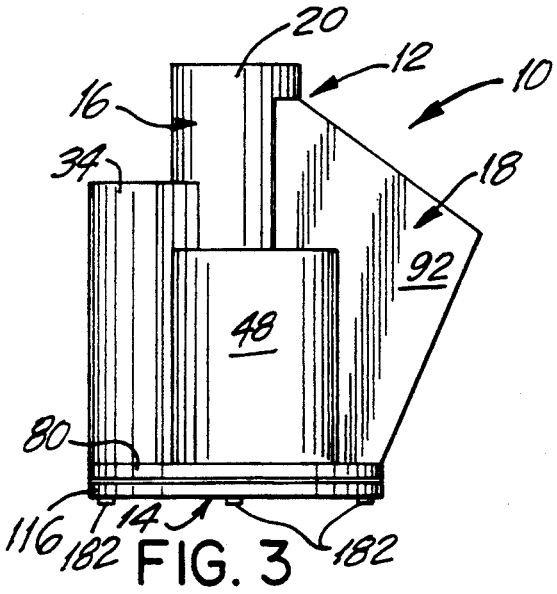
FIG. 3 is a side elevational view of the storage receptacle.
Figure 4:
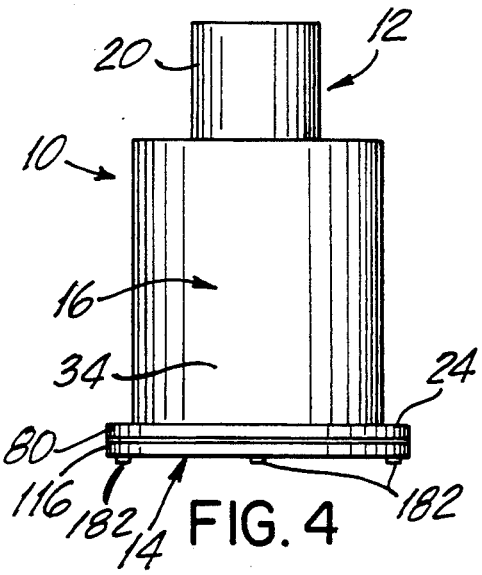
FIG. 4 is a rear elevational view of the storage receptacle.
Figure 5:
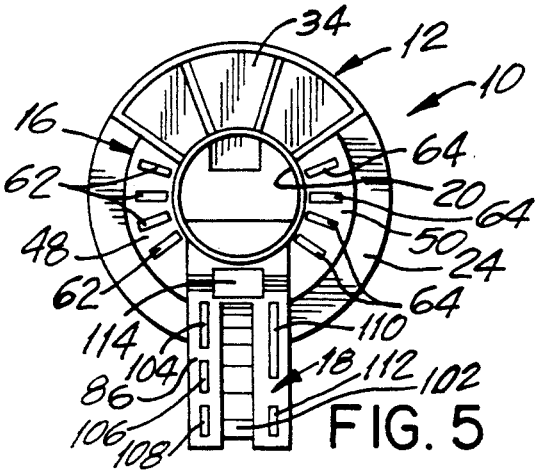
FIG. 5 is a top plan view of the storage receptacle.

Additionally, circularly spaced apart holes 180 are formed through the flat portion 164, where there are preferably four holes 180. The holes 180 are disposed between the skirt 166 and the bosses 174, where one hole 180 is adjacent to every other boss 174. Each of the holes 180 receives a support member 182 preferably fabricated from plastic or rubber-like material. Each support member 182 includes an enlarged circular head 184 and a shaft 186 having a tapered free end. Accordingly, the tapered end of each shaft 186 is inserted into an associated one of the holes 180 from the bottom surface of the flat portion 164, and then the rest of the shaft 186 is pushed into the associated hole 180 in a force-fit to secure the support member 182 to the flat portion 164. A downwardly extending boss 188 is provided on the bottom surface of the flat portion 164 around each of the holes 180, as shown in FIG. 17, in order to position the head 184 of the support member 182 in a spaced arrangement from the bottom surface of the flat portion 164. It is noted, as best shown in FIGS. 2, 3 and 4, that the head 184 extends outwardly slightly beyond the skirt 166 so that the storage receptacle 10 stands on the support members 182.

To assemble the storage receptacle 10, the first step is to insert the insert member 118 into the front section 18 so that the insert member 118 is secured therein in a fixed position, as set forth above. The next step is to position the rear edge 98 of the top wall 86 and the rear edges of the side walls 92, 94 of the front section 18 against the front wall of the central portion 20 of the body section 16 so that the locking tabs 152, 154 of the front section 18 are disposed above the top walls 54, 56 of the side storage portions 48, 50, and the lower portion of the front section 18 is disposed in the front opening 60 in the body section 16. In this position, the abutment tab 138 of the insert member 118 abuts against the central portion 20, and the locking tabs 152, 154 are disposed in alignment above the cut-outs 82, 84 in the front edges of the top walls 56, 58.

The front section 18 is now pushed downwardly along the central portion 20 so that the locking tabs 152, 154 enter into their respective cut-outs 82, 84. The front section 18 continues to be pushed down until the flanges 160, 162 on the bottom of the front section 18 come to rest in the recess 75 within the body section 16. In this position, the bottom edges of the side walls 92, 94 and the rear edge 100 of the bottom wall 90 of the front section 18 engage against the abutment member 46 of the bottom plate 24, the front edges of the ribs 160, 162 engage against the forward wall of the recess 75, and the hole 158 in the bottom wall 90 of the front section 18 is in alignment with the hole 74 in the bottom plate 24, where the locking tabs 152, 154 are still in their respective cut-outs 82, 84 so that the front section 18 cannot be pulled horizontally apart from the body section 16.

It is noted, that once the front section 18 and the body section 16 are connected, the top edges of the locking tabs 152, 154 are at the same level as the upper surfaces of the top walls 56, 58 to provide an asthetic appearance, and the front edges of the top walls 56, 58 and the front edges of the side walls 52, 54 are disposed against the side walls 92, 94 of the front section 18 to also provide an asthetic appearance. Furthermore, the rear edge 98 of the top wall 86 is disposed against the front wall of the central portion 20 above the front openings 32 and 60 in the body section 16. It is noted, that the abutment tab 138 on the insert member 118 is now disposed in the opening 32, and has no further function.

In order to prevent the front section 18 from being pulled vertically upwardly out of the body section 16, the self-threading screw 158 is inserted through the hole 70 in the bottom plate 24, and then is self-threaded into the hole 156 in the bottom wall 90 of the front section 18 to thus fixedly secure the front section 18 to the body section 16. It is noted, that the self-threading screw 158 exits into the interior of the front section 18. The receptacle portion 12 is now assembled.

Figure 6:
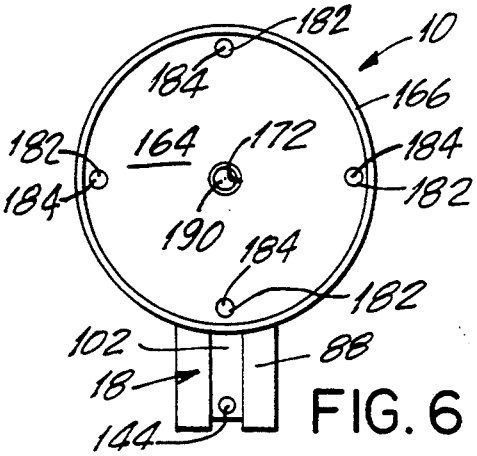
FIG. 6 is a bottom plan view of the storage receptacle.

The final step is to attach the base portion 14. Accordingly, the ball bearings 178 are positioned in their respective recesses 176 in the bosses 174. Then, with the upper surface of the base portion 14 facing up, the assembled receptacle portion 12 is disposed over the base portion 14 so that the pin 76, extending outwardly from the bottom surface 78 of the bottom plate 24, is in alignment with the hole 170 in the boss 168 on the top surface of the base portion 14. The receptacle portion 12 is now lowered so that the pin 76 passes through the hole 170 and the recess 172, and extends outwardly from the bottom surface of the flat portion 164 of the base portion 14. In this position, the bottom surface 78 of the bottom plate 24 rests on the ball bearings 178. Using conventional means well known in the art, the free end of the pin 76 is now flattened to form an enlarged head 190 disposed within the recess 172, as best shown in FIG. 6. Accordingly, the enlarged head 190 of the pin 76 is larger than the hole 170 so that the receptacle portion 12 is rotatably secured to the base portion 14 in such a manner that the receptacle portion 12 freely rotates on the ball bearings 178.

It is noted, that the support members 182 can be secured to the flat portion 164 of the base portion 14, in the manner set forth above, either before or after the base portion 14 is secured to the receptacle portion 12. The downwardly extending rim 80 on the bottom plate 24 conceals the bosses 174 and the ball bearings 178 therein for an asthetic appearance, as shown in FIGS. 1–4. It is noted, that the body section 16 and the front section 18 of the receptacle portion 12, as well as the base portion 14, are preferably fabricated from a plastic material.

Numerous alterations of the structure herein disclosed will suggest themselves to those skilled in the art. However, it is to be understood that the present disclosure relates to a preferred embodiment of the invention which is for purposes of illustration only, and is not to be cosntrued as a limitation of the invention.

What is claimed is:

1. A storage receptacle for knives and kitchen tools, utensils and gadgets, comprising:

a receptacle portion disposed on a base portion;

said receptacle portion including first means for receiving kitchen tools, utensils and gadgets therein, second means for receiving knives with short blades having the same length and width, and third means for receiving knives with long blades having different lengths and widths;

said third means including an inclined top wall having slots with different lengths to receive the long blades therethrough; and securement means for rotatably securing said receptacle portion to said base portion so that said receptacle portion rotates relative to said base portion.

2. A storage receptacle according to claim 1, wherein said third means includes a front storage portion having a front wall and side walls depending downwardly from said top wall and resting on a bottom plate of said receptacle portion, said top wall being inclined downwardly towards said front wall and said front wall being inclined upwardly towards said top wall to provide a V-shaped configuration, said top wall and said front wall extending outwardly beyond both said bottom plate and said base portion.

3. A storage receptacle according to claim 2, wherein said top wall has a rectangular cut-out therethrough to receive kitchen shears therein.

4. A storage receptacle according to claim 2, wherein an insert member is provided between said sidewalls and below said top wall, said insert member including means to maintain the long baldes in a straight inclined position relative to said top wall, and hook means for securing said insert member to said front wall.

5. A storage receptacle according to claim 2, wherein said first means includes a centrally located, hollow, circular central storage portion having an open top portion to receive kitchen tools, utensils and gadgets, said central storage portion extending upwardly beyond said front storage portion, rear edges of said top wall and side walls of said front storage portion being disposed against said central storage portion.

6. A storage receptacle according to claim 5, wherein said central storage portion has a closed bottom disposed above said bottom plate, said closed bottom having a step-like arrangement.

7. A storage receptacle according to claim 5, wherein said second means includes two side storage portions disposed on opposite sides of said central storage portion, each side storage portion including a top wall portion having slots to receive the short blades and a side wall portion depending downwardly from each associated top wall portion to said bottom plate, a side edge of each top wall portion being disposed against said central storage portion, and a front edge of each top and side wall portion being disposed against an associated one of said side walls of said front storage portion.

8. A storage receptacle according to claim 5, wherein said first means further includes a rear storage portion having a rear wall and opposing first and second sides extending upwardly from said base plate to provide a top opening for receiving kitchen tools and utensils, said first and second sides being secured to said central storage portion opposite said front storage portion.

9. A storage receptacle according to claim 8, wherein partition means extend from said rear wall to said central storage portion to partition said rear storage portion into adjacent sections.

10. A storage receptacle according to claim 8, wherein said second means includes two side storage portions disposed on opposite sides of said central storage portion between said front and rear storage portions, each of said side storage portions including a top wall portion provided with slots extending radially in a direction towards said central storage portion to receive the short blades.

11. A storage receptacle according to claim 1, wherein said base portion includes a circular flat portion having a downwardly extending circular skirt around the perimeter thereof, and support members extending downwardly from a bottom surface of said flat portion beyond said skirt for supporting said storage receptacle.

12. A storage receptacle according to claim 1, wherein said securement means includes a pin extending downwardly from a central bottom portion of said receptacle portion, a hole provided through a central portion of said base portion, said hole receiving said pin therethrough, and said pin having an enlarged head at an end thereof, said head being larger than said hole and being disposed against a bottom surface of said base portion to rotatably secure said receptacle portion to said base portion.

13. A storage receptacle according to claim 12, wherein ball bearing means are secured between a bottom surface of said receptacle portion and an upper surface of said base portion for rotating said receptacle portion relative to said base portion, said ball bearing means including numerous spaced-apart ball bearings.

14. A storage receptacle according to claim 13, wherein said receptacle portion includes downwardly extending skirt means to conceal said ball bearings.

15. A storage receptacle according to claim 1, wherein said receptacle portion includes a body section provided with said first and second means, and a front section provided with said third means, and attachment means for fixedly securing said body section and said front section together.

16. A storage receptacle according to claim 15, wherein said receptacle portion is provided with a front opening to receive a portion of said front section therein.

17. A storage receptacle according to claim 16, wherein said attachment means includes locking tabs provided on said front section, and cut-outs provided in said body section to slidingly receive said locking tabs therein.

18. A storage receptacle according to claim 17, wherein said attachment means further includes an abutment member on a bottom plate of said body section and a recess provided in said bottom plate, said recess being disposed between abutment member and said front opening, said front section portion being disposed in said front opening with a bottom portion thereof being disposed in said recess against said abutment member.

19. A storage receptacle according to claim 18, wherein said attachment means further includes screw means for securing said front section to said bottom plate of said body section.

20. A storage receptacle according to claim 1, wherein said receptacle portion and said base portion are fabricated from a plastic material, said receptacle portion being hollow.

* * * * *